United States Patent [19]

Kongoh

[11] Patent Number: 4,554,880

[45] Date of Patent: Nov. 26, 1985

[54] ELECTRONIC SEWING MACHINE

[75] Inventor: Takeshi Kongoh, Tokyo, Japan

[73] Assignee: Janome Sewing Machine Industry Co., Ltd., Tokyo, Japan

[21] Appl. No.: 604,745

[22] Filed: Apr. 27, 1984

[30] Foreign Application Priority Data

Apr. 30, 1983 [JP] Japan ..... 58-74927

[51] Int. Cl.[4] ..... D05B 3/02

[52] U.S. Cl. ..... 112/454

[58] Field of Search ..... 112/158 E, 158 F, 121.11, 112/121.12, 102, 103, 266.1, 454

[56] References Cited

U.S. PATENT DOCUMENTS 4,266,493 5/1981 Hanyu et al. ..... 112/158 E
4,280,424 7/1981 Carbonato et al. ..... 112/158 E
4,352,334 10/1982 Childs et al. ..... 112/266.1
4,383,489 5/1983 Sugiyama et al. ..... 112/121.12 X
4,434,729 3/1984 Davidson ..... 112/121.12

*Primary Examiner*—Peter Nerbun
*Attorney, Agent, or Firm*—Frishauf, Holtz Goodman & Woodward

[57] ABSTRACT

A control circuit of an electronically controlled sewing machine is arranged so that, in response to a signal generated from an electronic memory element connected to pattern selection switches and a memory switch, and during stitching operation of a letter pattern designated to be accompanied by a supplemental symbol or mark, data for controlling stitches of the designated letter pattern and the accompanying symbol or mark are read out from a stitch control data memory. The designated combination of the letter pattern and the accompanying symbol or mark will be stitched with a natural appearance.

4 Claims, 7 Drawing Figures

SEÑOR

Fig. 2A

て ゛ん し

Fig. 2B

で゛ん し

Fig. 3A

SEN˜OR

Fig. 3B

SEÑOR

ELECTRONIC SEWING MACHINE

BACKGROUND OF THE INVENTION

This invention relates to an electronic sewing machine having an electronic memory for storing a plurality of stitch control data corresponding to different patterns which patterns may be selectively chosen by the sewing machine operator. More particularly, the present electronic sewing machine is capable of automatically controlling the space between adjacent letters in stitch patterns when producing a combination of patterns including one or more letter stitch patterns accompanied by a supplemental mark pattern to be attached thereto.

In the conventional electronic sewing machine, it has been difficult or almost impossible to stitch a combination of letters, for example, the Japanese "でんし" which means "electron" in English, and the Spanish "SEÑOR" including the accompanying supplemental marks such as " ″ " and "~", because such accompanying symbols would have to be considered as one stitch pattern which should be arranged with an equal space with respect to the other letter patterns and therefore stitched in such a manner as "でんし" and "SEN~OR" as precisely shown in FIGS. 2A and 3A. This is also true with other letters, for example the umlaut in the German language.

SUMMARY OF THE INVENTION

Accordingly the present invention has been provided to avoid such disadvantages and inconveniences of the prior art.

It is an object of the invention to provide an electronic sewing machine according to which a combination pattern of letter stitches including an accompanying supplemental mark may be produced, with an automatically controlled space between the letter stitch pattern and the accompanying supplemental mark.

According to the invention, there is provided an electronic sewing machine of a type wherein there are provided stitch forming instrumentalities including a needle which is swingable transversely of a fabric feeding direction and is vertically reciprocated to penetrate a fabric to form stitches, and a fabric feed device operated in a timed relation with the needle to transport the fabric with respect to the needle, comprising in combination, an electronic data storing memory for storing stitch control data for controlling the needle position and the fabric feeding amount to produce a number of different patterns, the stitch control data including at least data for controlling the stitches of a letter pattern, data for controlling the stitches of a supplemental mark pattern to be attached to the letter pattern, and data for controlling relative spacing and position between the letter pattern and the supplemental mark pattern; first switch means selectively operated to produce a pattern signal for selecting a desired one of the patterns stored in the memory; pattern signal control means; second switch means operated to designate patterns selected by the first switch means to be memorized by the pattern signal control means, the pattern signal control means producing a signal indicating the presence of a letter pattern requiring the supplemental mark pattern while the data storing memory issues the data of the letter pattern; and circuit means operated in response to the indication signal of the pattern signal control means, after the data storing memory issues the data of the letter pattern, to read out from the data storing memory the data for controlling the stitches relating to the letter pattern and its required supplemental mark pattern.

BRIEF DESCRIPTION OF THE DRAWINGS

The foregoing and further objects and advantages of the invention can be fully understood from the following detailed description when read in conjunction with the accompanying drawings in which:

FIGS. 2A and 2B show an example of a combination letter stitch pattern, wherein FIG. 2A shows an example which may have been produced in the prior art and FIG. 2B shows an example which may be produced according to the invention;

FIGS. 3A and 3B show another example of a combination letter stitch pattern, wherein FIG. 3A illustrates an example which may have been produced in the prior art whereas FIG. 3B illustrates an example which may be produced according to the invention;

PREFERRED EMBODIMENT OF THE INVENTION

Figure 1:
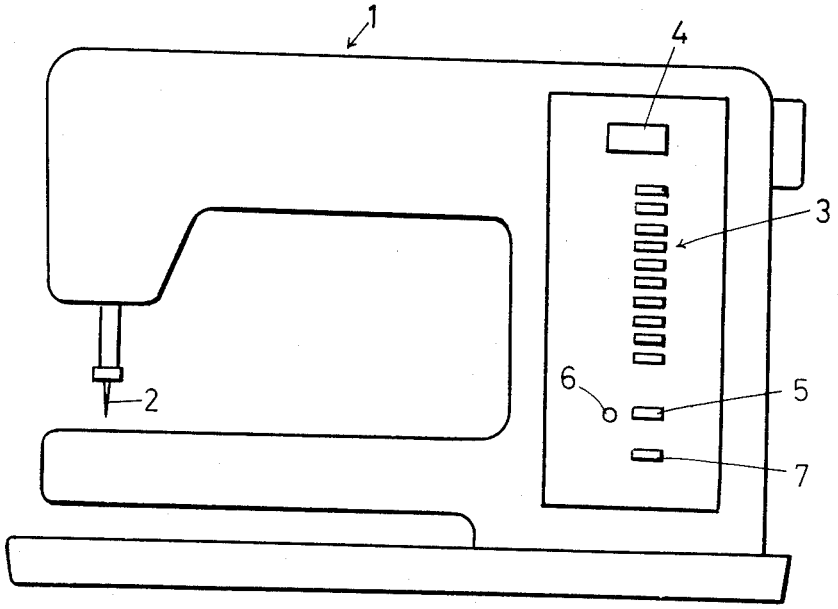
FIG. 1 is a front view showing an electronic sewing machine of the invention.

Referring to FIG. 1, in a machine housing 1 of an electronically controlled sewing machine there is provided an electronic memory (not shown) storing a plurality of stitch control data for controlling needle lateral amplitude and fabric feeding amount per stitch of a stitch pattern. A desired pattern may be selected from a plurality of stitch patterns by selectively operating pattern selecting switches 3 to designate a corresponding pattern number. The selected pattern number is indicated at a digital indicator 4. A memory switch 5 is operated each time after the pattern selecting switches 3 have been relatively operated, to thereby sequentially memorize a group of patterns. A light emitting diode 6 indicates the sewing machine is ready for sequentially producing the stitch patterns memorized by operation of the memory switch 5. For cancelling the memorized patterns, a cancel switch 7 is operated.

Figure 4:
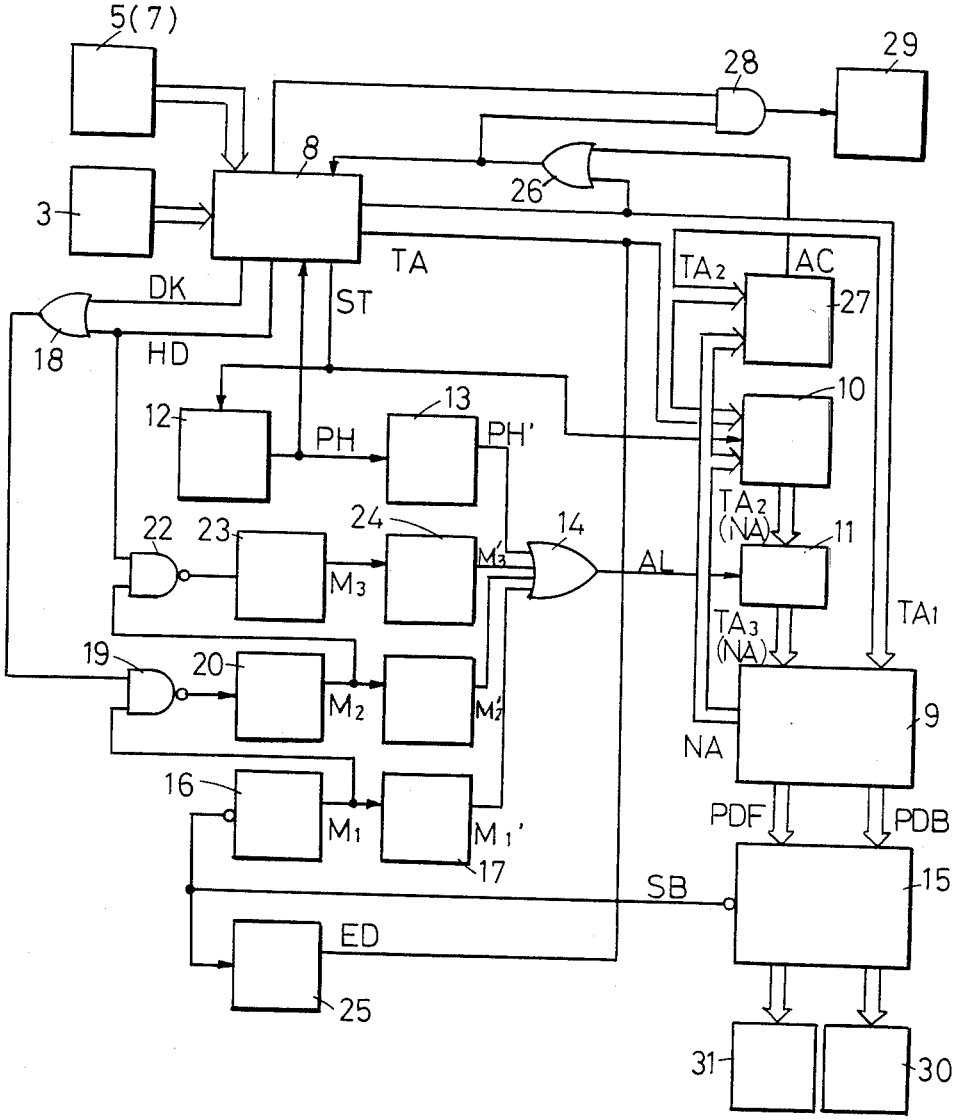
FIG. 4 is a block diagram of a control circuit according to the invention.

FIG. 4 is a block diagram of a control circuit of the invention. More particularly, the selective operation of the pattern selecting switches 3 to select a desired one of the stitch patterns, gives a corresponding pattern number signal to a pattern number control unit 8, which will then produce an address signal (TA) for reading out the data of needle lateral amplitude and fabric feed amount for the first stitch of the selected pattern. At the same time, the control unit 8 will produce a start signal (ST) of "H" level. The address signal (TA) thus supplied from the control unit 8 is divided into two parts, the first part ($TA_1$) of which is applied to a memory 9 for storing stitch control data for a plurality of stitch patterns, and the other part ($TA_2$) of which is applied to a comparator circuit 27 and a first multiplexer 10, respectively. The multiplexer 10 then produces the second address signal ($TA_2$) while receiving the "H" level start signal (ST) from the control unit 8. When the start signal (ST) becomes the "L" level, a next address signal (NA) is supplied from the multiplexer 10 in place of the second address signal ($TA_2$). The address signal ($TA_2$) or (NA)

is latched in a latch circuit 11 at each rising time of an address latch signal (AL).

An upper shaft signal generator 12 produces a phase signal (PH) at a rising time of the start signal (ST). This phase signal (PH) becomes the address latch signal (AL) via a differential circuit 13 and an OR circuit 14. During the stitching operation, the generator 12 produces the "H" level phase signal (PH) each time the needle 2 ascends to reach above the sewn material, which is then changed to the "L" level when the needle 2 penetrates the material.

With the address signals ($TA_1$) and ($TA_2$), the memory 9 produces the needle amplitude control data PDB and the feed amount control data PDF for the first stitch of the selected stitch pattern, which data are fed to a discriminator 15, and the next address signal (NA) for reading out the next stitch control data which signal (NA) is fed back to the multiplexer 10. When the needle 2 descends to penetrate the material so as to change the phase signal (PH) to the "L" level, the next address signal (NA) is supplied from the multiplexer 10 and then latched in the latch circuit 11. The latch signal is then given to the memory 9 whereat the needle amplitude control data PDB and the feed amount control data PDF for the second stitch of the selected stitch pattern are read out. The control data PDB and PDF for the selected pattern are sequentially read out in such manner.

The memory 9 also stores the control data PDB and PDF for a character which may be accompanied by some symbol (e.g., the tilde "~" accompanying the character "N" in Spanish or accompanying a vowel letter in Portuguese; the umlaut "¨" accompanying the character "a", "o" or "u" in German; the sonant-dot "゛" used as in the Japanese letters "ど", "ゎ", etc.), as shown in Table I which includes one or more of data for controlling the space between the character and the accompanying symbol to be sequentially stitched, e.g., the space between the letter "〃" and the sonant-dot "ど" in the Japanese word "ど〃ん". More particularly, the data shown in Table I has the control data PDB and PDF for the first stitch of the selected pattern and the next address signal ($NA_2$) for the next stitch which can be read out in response to the address signal ($TA_2$) applied to the memory 9, and the control data PDB and PDF for the subsequent step of formation of the selected pattern can be sequentially read out. When the control data PDB and PDF are read out for the last stitch, the next address signal ($NA_0$) coupled therewith is produced from the memory 9 for reading out the discrimination data which will be fed to the discriminator 15, wherein it is determined if the selected character should be accompanied by some symbol, and in the affirmative case a fragment signal (SB) of "L" level is produced therefrom. As will be described in detail, in response to the discrimination data, the next address signal ($NA'_0$), ($NA''_0$) and ($NA'''_0$) will be successively produced to thereby selectively read out one of the data for determining the space to be left between the last stitch of the selected letter stitch pattern and the first stitch of the subsequent stitch pattern, which may be another letter or a symbol accompanying that letter stitch already stitched. When the last data of the selected letter stitch pattern is selectively read out by one of the address signals ($NA'_0$), ($NA''_0$) and ($NA'''_0$), the next address signal ($NA''_0$), ($NA'''_0$) or ($TA_2$) coupled with the last data of the selected stitch pattern is produced as a command manifesting the completion of formation thereof. For letters such as "B" which can not be accompanied by any symbol, and also for accompanying symbols, the memory 9 stores corresponding data as shown in Table II, and more particularly, the next address signal ($NA_0$) coupled with the control data for the last stitch is produced for reading out the data for spacing the next stitch pattern (not comprising an accompanying symbol) from the completed character stitch.

Figure 5:
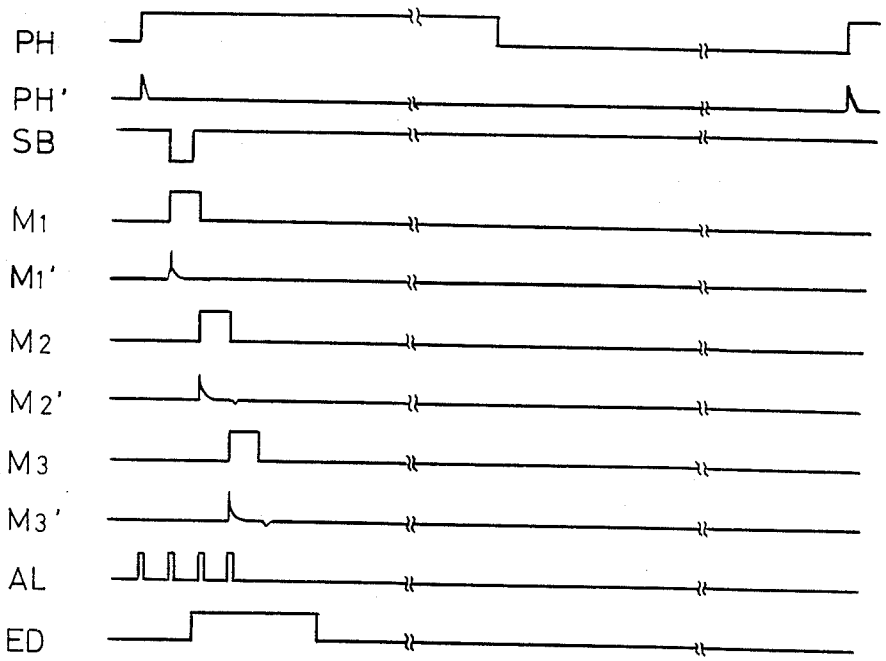
FIG. 5 is a pulse form diagram showing the operation of the principal elements of the control circuit of the invention.

The operating characteristics of the principal circuit of the control elements according to the invention are illustrated in FIG. 5. More particularly, the signal (PH') produced at the rising time of the phase signal (PH) from the signal generator 12 will generate the address latch signal (AL) via the OR circuit 14 toward the latch circuit 11, which then gives the next address signal (NA) to the memory 9. Where this next address signal (NA) will read out the discrimination data (Table I) from the memory 9, the data discriminator 15 generates the "L" level signal (SB) at a little delayed timing. A one-shot multivibrator 16 is operated in response to the falling time of the signal (SB) to produce a signal ($M_1$), which is then converted to a signal ($M'_1$) via a differential circuit 17. Thus, the address latch signal (AL) is again produced by the OR circuit 14, so that the ordinary space control data for providing a predetermined space between two adjacent two letter stitches, is read out when the switches 3 and 5 have been so operated as to designate no accompanying symbol with respect to the selected character pattern. On the contrary, when some symbol has been designated to accompany the preceeding letter stitch, the control unit 8 will be operated such that one of two accompanying symbol designating signals (DK) and (HD) is selectively made "H" level in accordance with the designation of the accompanying symbol, during a stitching operation of a selected combination stitch pattern including a character and an accompanying symbol. An effective output of an OR circuit 18 is connected to one input of an AND circuit 19. Thus, a second one-shot multivibrator 20 produces the effective signal ($M_2$) at a falling point of the signal ($M_1$) from the first one-shot multivibrator 16, which signal ($M_2$) is converted to a signal ($M'_2$) differentiated by a differential circuit 21, resulting in the address latch signal (AL) being produced by the OR circuit 14 and read out of the space control data for the first group of the accompanying symbols (Table I). When the second group accompanying symbol designating signal (HD) is the "H" level, a second AND circuit 22 having both inputs connected to the "H" level signals will cause a third one-shot multivibrator 23 and a differential circuit 24 to produce effective signals ($M_3$) and ($M'_3$) respectively, whereby another space control data for the second group accompanying symbols (Table II) is read out from the memory 9. Respective differential circuits 13, 17, 21 and 24 are operated in response to the rising points of the signals applied thereto to produce the "H" level signals, but are not responsive to the falling points thereof, as clearly shown in FIG. 5.

Another one-shot multivibrator 25 is responsive to the rising point of the signal (SB) to thereby produce the "H" level signal (ED), which is given back to the control unit 8 via an OR circuit 26. The control unit 8 will become ready for producing the subsequently designated stitch pattern, after operation of the signal ($M_3$) from the one-shot multivibrator 23 has been completed. The stitch control data memory 9 includes the second address signal ($TA_2$) memorized in combination with the second group symbol space control data (Table I) or the ordinary space control data (Table II), which is transmitted to the comparator circuit 27. The comparator circuit 27 will detect whether the next address signal (NA) from the memory 9 coincides with the second address signal ($TA_2$) from the control unit 8 and, in the affirmative case produce a coincidence signal (AC) to the control unit 8 via the OR circuit 26. In response to the end signal (ED) or the coincidence signal (AC) thus applied, the control unit 8 is operated to actuate a brake unit 29 via an AND circuit 28, so that the sewing machine is stopped from operation. A needle control unit 30 and a feed control unit 31 receive the needle amplitude control data PDB and the feed amount control data PDF from the discriminating circuit 15 to control the needle lateral amplitude and the fabric feed amount per stitch of the selected stitch pattern.

The control circuit according to the invention operates as follows: when the sewing machine operator manipulates the switches 3 and 5 to designate a combination of stitch patterns "SENOR", for example, to be produced in series, the address signal (TA) for the first pattern "S" is supplied from the control unit 8, the first part of which ($TA_1$) is given to the stitch control data memory 9 and the other part of which ($TA_2$) is given to the multiplexer 10. Meanwhile, the control unit 8 produces the start signal (ST). The address latch circuit 11 which has received the second address signal ($TA_2$) from the multiplexer 10 will then generate the signal ($TA_2$) to the memory 9, in response to the address latch signal (AL) from the OR circuit 14 which is made "H" level due to the "H" level phase signal (PH). Then, the needle amplitude control data PDB and the fabric feed amount control data PDF for the first stitch of the pattern "S" are read out from the memory 9, thereby actuating the control units 30 and 31 respectively. Then the stitching operation of the pattern "S" may be continued in the same manner as above described, in accordance with the data as shown in table II which will be applicable for a pattern with no accompanying mark. Thus, the last data, that is the ordinary space control data is read out from the memory 9, and at the same time the next address signal ($TA_2$) is given to the comparator circuit 27. The coincidence signal (AC) is produced from the comparator circuit 27 to the control unit 8 for the next pattern "E". Then, the pattern "E" is continuously stitched in the same manner in accordance with the data also as shown in Table II. The pattern "E" is produced with the predetermined ordinary space from the first pattern "S" according to the ordinary space control data memorized in the stitch control data of the pattern "S" that is as shown in Table II. Next, the stitching operation of the pattern "N" will be started after leaving the predetermined ordinary space from the preceedingly formed pattern "E" which is established according to the ordinary space control data of the pattern "E". Since the mark "~" which is to be stitched accompanying the letter "N" has been designated in the control unit 8, the tilde mark "~" designating signal (DK) of "H" level is produced from the control unit 8 during the stitching operation of the pattern "N". The stitching operation is continued in accordance with the control data as shown in Table I, so that the discrimination data is read out from the memory 9 when stitching of the pattern "N" has been completed. Then, the discriminating circuit 15 produces the signal (SB) directing the one-shot multivibrator 16 to generate the signal ($M_1$). In response to the effective signals (DK) and ($M_1$), the one-shot multivibrator 20 will produce the signal ($M_2$) via the AND circuit 19 to thereby read out the space control data for the tilde mark "~", according to which the control units 30 and 31 are actuated to designate the coordinates for the first stitch of the tilde mark "~". Thereafter, in response to the end signal (ED) from the one-shot multivibrator 29, the tilde "~" will be stitched in accordance with the control data thereof as shown in Table II. The subsequently designated patterns "O" and "R" are successively stitched in the same manner, while spacing the preceeding patterns "~" and "O" respectively according to the ordinary space control data of the patterns "~" and "O" which are as shown in Table II. When the stitching operation of the pattern "R" has been completed, the comparator circuit 27 receives the same signal ($TA_2$) from the memory 9 and the control unit 8 to thereby produce the coincidence signal (AC), in response to which the control unit 8 is operated to actuate the brake unit 29. The brake unit 29 will thus deenergize the sewing machine with the needle 2 positioning at the upper dead point.

Although the operation of the control circuit of the invention has been described in relation to formation of the pattern as shown in FIG. 3B, it is readily understood that other patterns including one of more or accompanying supplemental marks to be stitched to accompany a preceeding letter stitch, another example thereof being shown in FIG. 2B, can be automatically produced in the same manner.

A number of accompanying symbols or marks may be classified into two groups, for example the first group including the tilde and the other group including the umlaut. However, there can be provided three or more groups of accompanying symbols or marks.

While the invention has been described in conjunction with a specific embodiment thereof, it is to be understood that many modifications and variations may be made without departing the spirit and scope of the invention as defined in the appended claims.

TABLE I

| PDB, PDF | NA |
|---|---|
| DATA FOR 1ST STITCH | $NA_2$ |
| DATA FOR 2ND STITCH | $NA_3$ |
| DATA FOR FINAL STITCH | $NA_0$ |
| DISCRIMINATION DATA | $NA'_0$ |
| SPACE CONTROL DATA FOR ORDINARY LETTER | $NA''_0$ |
| SPACE CONTROL DATA FOR 1ST GROUP ACC. MARK | $NA'''_0$ |
| SPACE CONTROL DATA FOR 2ND GROUP ACC. MARK | $TA_2$ |

TABLE II

| PDB, PDF | NA |
|---|---|
| DATA FOR 1ST STITCH | $NA_2$ |
| DATA FOR 2ND STITCH | $NA_3$ |
| DATA FOR FINAL STITCH | $NA_0$ |
| SPACE CONTROL DATA FOR ORDINARY LETTER | $TA_2$ |

What is claimed is:

1. In an electronic sewing machine having an upper drive shaft and stitch forming instrumentalities operatively connected to the upper drive shaft and including a needle which is swingable transversely of a fabric feeding direction and is vertically reciprocated per rotation of the upper drive shaft to penetrate a fabric to form stitches thereon, and a fabric feeding device operated in timed relation with the needle to transport the fabric with respect to the needle, the improvement comprising, in combination, a pulse generator operated in association with said upper drive shaft to produce a timing pulse per rotation of the upper drive shaft;

an electronic memory for storing at successive addresses stitch control data for controlling a needle position and a fabric feeding amount to produce a number of different stitch patterns, said stitch control data including data for producing stitches of different characters some of which require a supplemental mark to provide specific meaning to a word, data for providing a predetermined space between the characters to be stitched in sequence, data for producing stitches of the supplemental mark to be associated with a character, data for positioning the stitches of the supplemental mark with respect to the associated character, and for discriminating the presence of said character requiring the supplemental mark to be stitched, said memory being responsive when addressed, to said timing pulse of said pulse generator to read out sequentially said stitch control data;

first switch means including a number of switches each selectively operated to produce a pattern signal to select a desired one of said patterns stored in said memory;

pattern signal control means responsive to said pattern signal to latch the same and for addressing said memory to read out the corresponding stitch control data;

second switch means alternatingly operated with said first stitch means to memorize in said pattern signal control means a desired number of pattern signals as selected by operation of said first switch means, wherein said pattern signal control means is operated to address said memory and adapted to produce an indicating signal during a stitching operation of the machine indicating the presence of a character requiring the supplemental mark to be subsequently stitched when the pattern signals of such a character are memorized;

discriminator means arranged to receive said stitch control data from said memory and to produce a discriminating signal; and circuit means coupled to said discriminator means and said pattern signal control means, and responsive to said discriminating signal for designating the next address of said memory, said circuit means responsive to said indicating signal from said pattern signal control means immediately after issuance of said discriminating signal to produce a signal to designate the address immediately after said next address of said memory during one rotation of said upper drive shaft for reading out from said memory in combination the data of said supplemental mark and the data for positioning the stitches of said supplemental mark with respect to its associated character.

2. The electronic sewing machine of claim 1, wherein said electronic memory stores next address signals which are produced in response to an initial address signal from said pattern signal control means, to address successively said memory with respect to each of said selected patterns; and further comprising a comparator for comparing said initial address signal and each of said next address signals, said comparator providing an accord signal to said pattern signal control means when the last address of the last pattern is in accord with said initial address signal, and breaking means responsive to said accord signal to stop operation of the machine.

3. The electronic sewing machine of claim 2, wherein said discriminating signal is of low level to activate said circuit means, said signal being changeable to a high level; and further comprising trigger means responsive to the discriminating signal of high level to produce a signal indicating that a currently stitched pattern is finished, wherein said pattern signal control means produces a new initial address signal for the next pattern memorized therein.

4. The electronic sewing machine of claim 3, further comprising switch means operated to clear said set of pattern signals memorized in said pattern signal control means.

* * * * *